US005478068A

United States Patent [19]

Schroeder

[11] Patent Number: 5,478,068

[45] Date of Patent: Dec. 26, 1995

[54] WHEELED PORTABLE BASKETBALL GOAL ASSEMBLY

[75] Inventor: Edward A. Schroeder, Marengo, Ill.

[73] Assignee: Porter Athletic Equipment Company, Broadview, Ill.

[21] Appl. No.: 377,987

[22] Filed: Jan. 25, 1995

Related U.S. Application Data

[63] Continuation-in-part of Ser. No. 267,933, Jul. 6, 1994, Pat. No. 5,390,914, which is a continuation of Ser. No. 98,725, Jul. 29, 1993, abandoned, and a continuation of Ser. No. 90,457, Feb. 8, 1994, abandoned, and a continuation-in-part of Ser. No. 921,645, Jul. 30, 1992, and a continuation-in-part of Ser. No. 181,436, Jan. 14, 1994.

[51] Int. Cl.[6] ..... A63B 63/08

[52] U.S. Cl. ..... 273/1.5 R

[58] Field of Search ..... 273/1.5 R, 1.5 A, 273/413

[56] References Cited

U.S. PATENT DOCUMENTS

| | | | |
|---|---|---|---|
| 278,797 | 6/1883 | Ide | 248/292.1 |
| 3,018,102 | 1/1962 | Murphy | 273/1.5 R |
| 3,137,502 | 6/1964 | Duganich | 273/1.5 R |
| 4,465,277 | 8/1984 | Dittrich | 273/1.5 A |
| 4,526,367 | 7/1985 | Haston et al. | 273/1.5 R |
| 4,706,964 | 11/1987 | Genovese | 273/413 |
| 4,801,142 | 1/1989 | Friesen | 273/1.5 R |
| 4,946,163 | 8/1990 | Aakre et al. | 273/1.5 R |
| 5,098,092 | 3/1992 | Aakre et al. | 273/1.5 R |
| 5,102,128 | 4/1992 | Geise | 273/1.5 R |
| 5,133,547 | 7/1992 | Pardi | 273/1.5 R |
| 5,390,914 | 2/1995 | Schroeder | 273/1.5 R |

FOREIGN PATENT DOCUMENTS

| | | |
|---|---|---|
| 2234942 | 2/1973 | Germany . |
| 286216 | 11/1962 | Netherlands . |

OTHER PUBLICATIONS

Porter "535" Portable, Porter Athletic Equipment Company Publication Date Not Known.

*Primary Examiner*—William H. Grieb
*Attorney, Agent, or Firm*—Barnes & Thornburg

[57] ABSTRACT

A portable basketball goal system including at least one first wheel adjacent to the rear end of the base and at least one second wheel adjacent to the top of the support structure. By tilting the base onto the first wheel and the other end of the support including the backboard and rim combination onto the second wheel, the total structure is supported on wheels. A parallelogram structure which adjustably mounts the backboard-rim combination to the support includes an extension extending past the support and the second wheel is adjacent to the end of the extension. A backboard-rim height adjustment link may include a first vertical section adjustably connected to the support and a second section extending from the first section at an obtuse angle and connected to the extension.

20 Claims, 4 Drawing Sheets

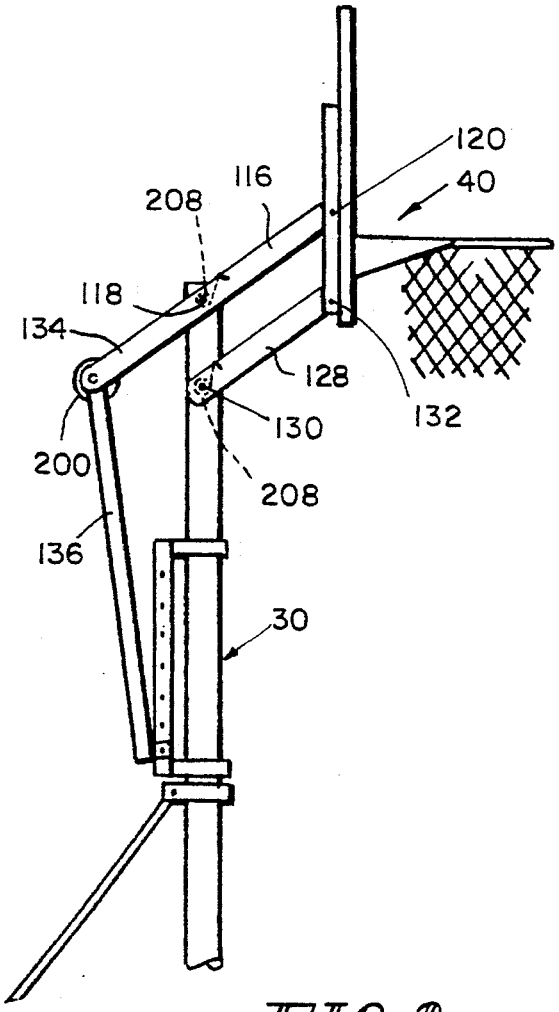
FIG. 8
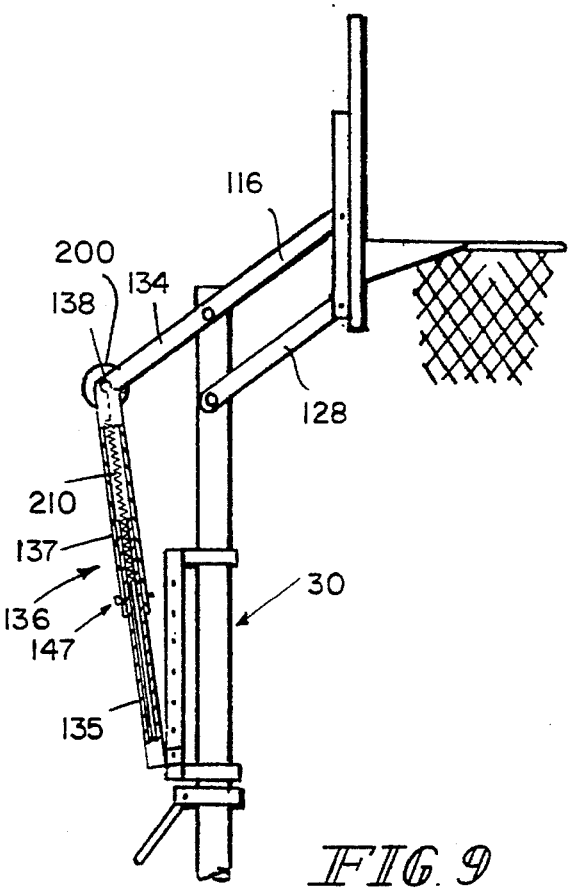
FIG. 9
FIG. 7
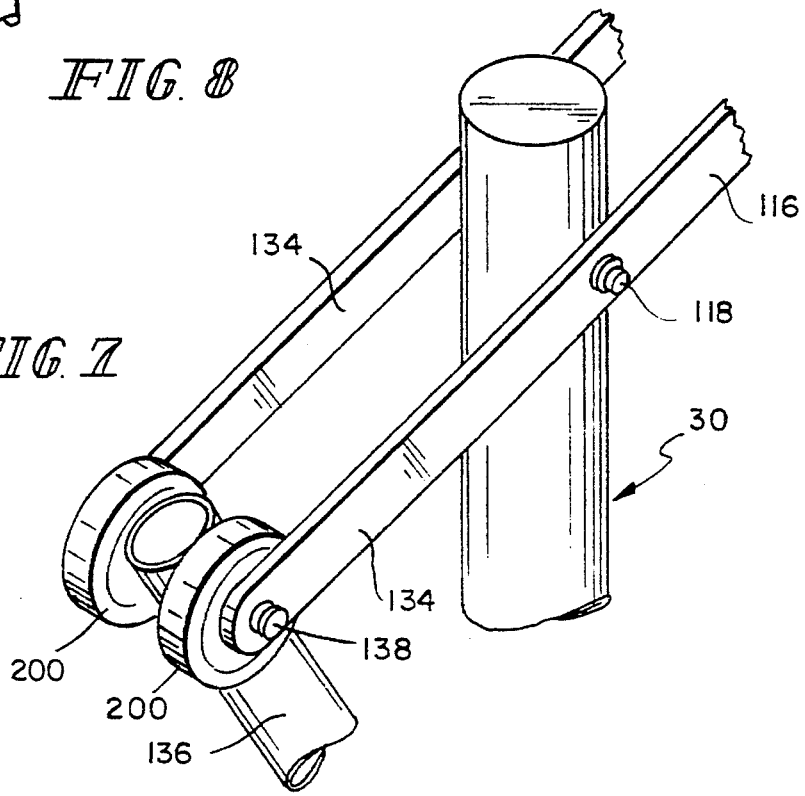

WHEELED PORTABLE BASKETBALL GOAL ASSEMBLY

CROSS-REFERENCE

This is a continuation-in-part of the U.S. patent application Ser. No. 08/267,933 filed Jul. 16, 1994, now U.S. Pat. No. 5,390,914 which is a continuation of Ser. No. 08/098,725 filed Jul. 29, 1993 now abandoned and of Ser. No. 08/090,457 filed Feb. 8, 1994 now abandoned and a continuation-in-part of U.S. application Ser. No. 07/921,645 filed Jul. 30, 1992 and a continuation-in-part of U.S. application Ser. No. 08/181,436 filed Jan. 14, 1994.

BACKGROUND AND SUMMARY OF INVENTION

The present invention is generally to portable basketball goal assemblies and more specifically to foldable, portable basketball goal assemblies.

Portable basketball goal assemblies have many structures and methods of operation. The most simple is a weighted base with one or more wheels wherein the erect support for the backboard is tilted back over the wheel to be transported as illustrated in U.S. Pat. No. 3,025,058 to Brumfield. Other structures have been disassembled into a planar configuration as illustrated by U.S. Pat. Nos. 3,716,234 to Lancellotti and 4,869,501 to Anastasakis. Others include a vertical support structure which collapses vertically as illustrated in U.S. Pat. Nos. 4,526,367 to Haston, et al. and 5,102,128 to Geise. Further examples of wheeled bases which are portable without adjustment are shown by U.S. Pat. No. 3,722,886 to Sinner, U.S. Pat. No. 5,207,407 to Fitzsimmons, et al. and U.S. Pat. No. 5,248,140 to Matherne et al. In the addition to the above, an example of a wheeled support having an enclosure for receiving ballast is exemplified by U.S. Pat. No. 3,841,631 to Dolan.

An example of a system using pivotal links or braces to collapse the assembly into a planar position and rotating it up on a series of wheels an the base is illustrated by U.S. Pat. Nos. 4,946,163 and 5,098,092 to Aakre, et al. Porter Athletic Equipment Co. has a Model "535" which collapse to a planar position on a base and then the base is lifted and the unit is transported on wheels on the support adjacent the parallelogram connection of the backboard-rim combination. Since this an unweighted base, the wheels support the weight of the backboard-rim combination. This method of transport is not usable with weighted bases.

A more recent design of foldable, portable basketball goal assemblies have a vertical support pivotally connected adjacent a front end of a hollow base filled with ballast and a brace structure connected at opposite ends to the support and the base adjacent the other end of the base. Such structures are illustrated in my copending application 08/267,933 shown in FIGS. 1 and 2 and 08/190,457 as well as U.S. Pat. No. 5,259,612 to Matherne et al. The brace locks the support in an erect playing position or in a lowered transport position greater than horizontal.

In foldable, portable systems, there is also question of safety of the user as the brace is adjusted from its erect playing position to its lowered transport position. The sliding brace structure of U.S. Pat. No. 5,259,612 provides stops which create a surface that could pinch the fingers of the user. In the lowered transport position, a mechanism should be provided which positively defines this position and prevents further collapsing of the support thereby preventing injury to the user.

In these systems, the weighted base attempts to counterbalance the weight of the backboard which is carried by the user during transport. Although the systems are designed to be used by adults, young children will attempt to transport the basketball system. These basketball systems may tip over completely either during the conversion from the erect to the transport position or during transport producing possible injury to the operator as well as possible damage to the backboard and its support and adjustment structure. Since most of the systems include a backboard adjustment structure, grabbing the backboard is not a secure element and it may shift. Such a structure is illustrated in FIGS. 1 and 2. The prior art height adjustment mechanism is illustrated as parallelogram structure 46 in FIGS. 1 and 2.

Another area of possible injury, in adjustable backboards having a parallelogram structure connecting the backboard-rim combination to the support, is the ratchet mechanisms used to lock the parallelogram in its various adjusted positions. An adjustable parallelogram structure which does not include this ratchet mechanism is the+e "U-CAN-SLAM" model offered by Porter Athletic Equipment Company. This includes an extension of one leg of the parallelogram past the support and an adjustment element connecting the extension to the support in its various adjusted positions. Such structure is described in the above mentioned U.S. patent application Ser. No. 07/921,645. This particular structure has not been applied to a portable backstop.

Playground equipment must meet child safety standards which require that upward facings Vs must be eliminated from the structure. These Vs have been the source of children's heads being caught, causing possible strangulation or breaking of the neck. Although basketball backboard support structures have not been considered playground equipment, it may be preferable to eliminate such Vs from the basketball support systems.

Thus it is an object of the present invention to provide a portable basketball assembly which is more stable during transport.

Another object of the present invention is to provide a portable basketball goal assembly which has a playing and a transport position which are positively and fixedly defined.

A further object of the present invention is to provide a portable goal basketball assembly which is easy and safely converted from an erect play position to a lowered transport position.

An even further object of the present invention is to provide a portable goal basketball assembly which is free-standing in its lowered transport position.

A still even further object of the present invention is to provide a adjustable basketball support structure which eliminates upward facing Vs.

These and other objects are achieved by providing at least one first wheel adjacent to the rear end of the base which has a support connected at the front end and at least one second wheel adjacent to the top of the support structure. By tilting the base onto the first wheel and the other end of the support including the backboard and rim combination onto the second wheel, the total structure is supported on wheels. The support may be pivotally connected to the front end of the base and a brace assembly is provided to fix the support in an erect playing position or in a lowered transport position. Preferably a parallelogram structure which adjustably mounts the backboard-rim combination to the support includes an extension extending past the support and the second wheel is adjacent to the end of the extension of the leg of the parallelogram. An adjustment link adjustably connects the extension to the support to determine the height of a backboard-rim combination.

The adjustment link and the second wheel are connected to the extension on a common axis and the one or more second wheels act as axial spacers between the adjustment link and the extension. The adjustment link may include a first vertical section adjustably connected to the support and a second section extending from the first section at an obtuse angle and connected to the extension. A mechanism is provided for maintaining the vertical section, substantially vertical and adjacent to the support. The juncture of the first and second sections is 6 feet or above when the adjustment mechanism determines the highest height of the backboard-rim combination. The two section adjustment link may be used with the extension of the parallelogram on a portable or a non-portable adjustment backboard support structure.

Method of transporting a basketball goal assembly, as just described, would include tilting the base from a playing position towards a transport position and on to the first wheel. The continued angular motion of the base tilts the parallelogram structure and backboard-rim combination onto the second wheels for transport. Preferably, the backboard-rim combination is adjusted to its lowest position prior to any tilting of the base. Where the support is pivotally connected to the base, the support is rotated from its erect playing position to its lower transport position relative to the base also prior to tilting the base.

Other objects, advantages and novel features of the present invention will become apparent from the following detailed description of the invention when considered in conjunction with the accompanying drawings.

BRIEF DESCRIPTION OF THE DRAWINGS

FIG. 7 is a partial perspective of a portion of the portable basketball goal assembly of FIG. 4.

FIG. 8 is a side schematic view of another embodiment of the portable backboard goal assembly using torsion springs as a counterbalance and incorporating the principles of the present invention.

FIG. 9 is a side schematic view of a portable basketball goal assembly including a tension spring as a counterbalance and incorporating the principles of the present invention.

DETAILED DESCRIPTION OF THE DRAWINGS

Figure 1:
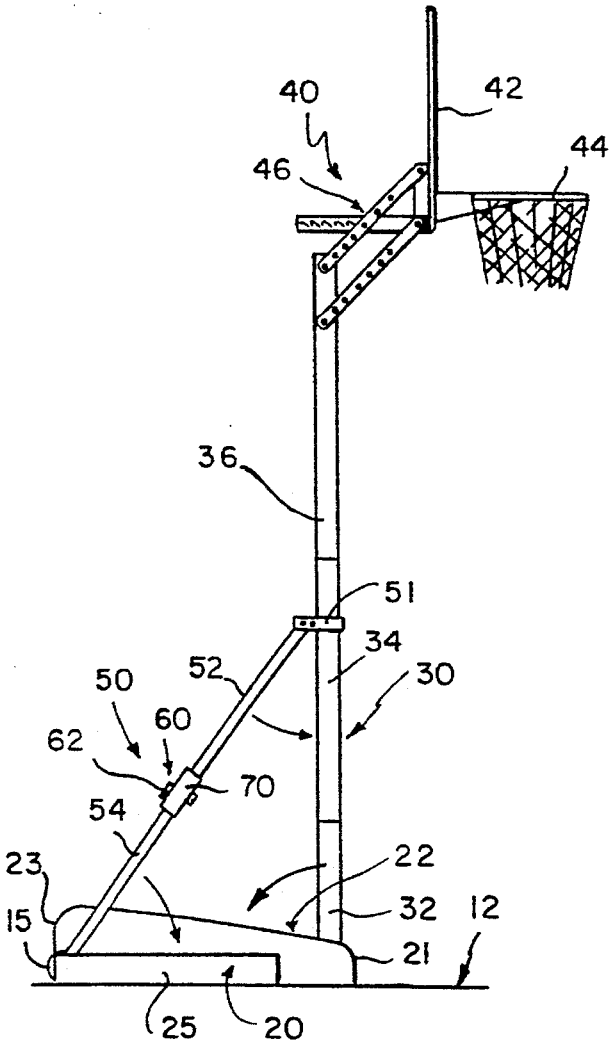
FIG. 1 is a side schematic view of a portable basketball goal assembly in its playing condition.
Figure 3:
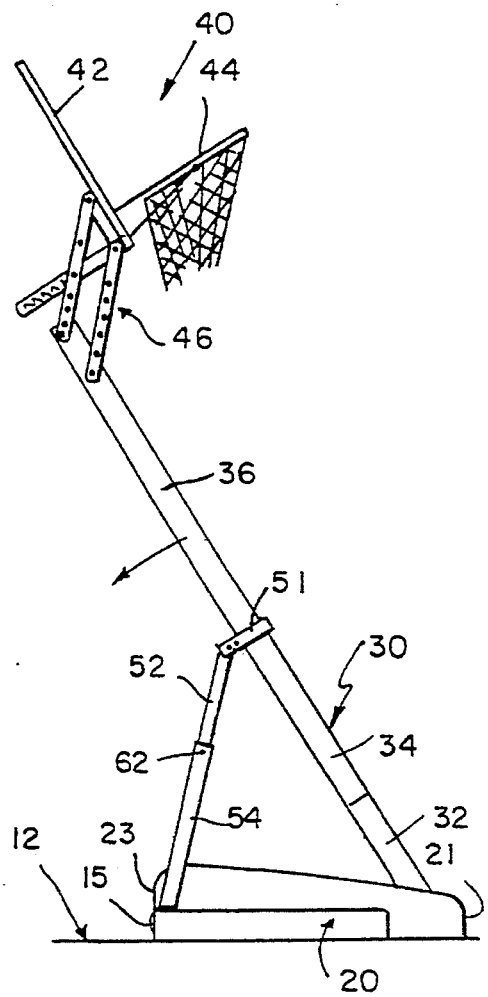
FIG. 3 is a side schematic view of another portable basketball goal in its lowered non-transport position.
Figure 2:
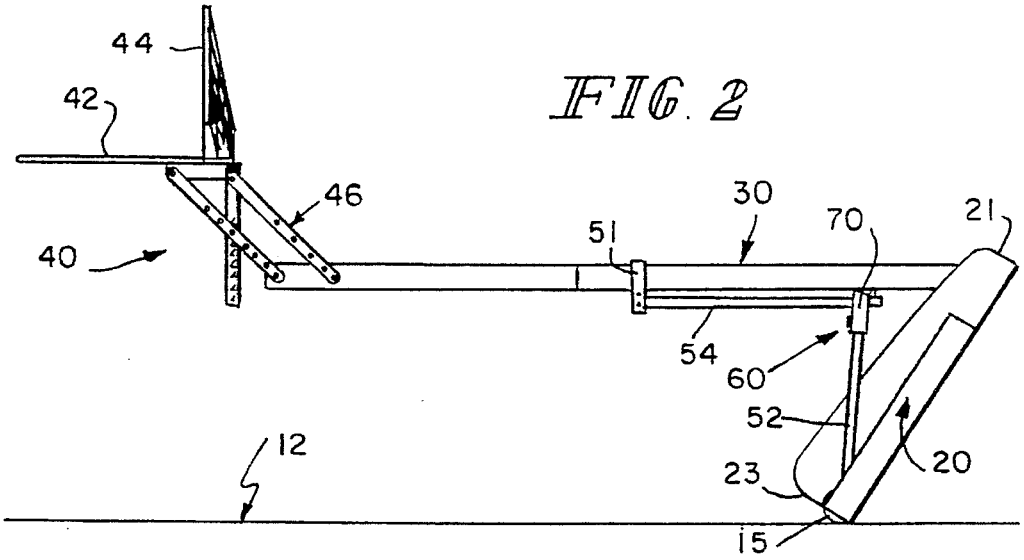
FIG. 2 is a side schematic view of the foldable, portable basketball goal assembly of FIG. 1 in its lowered and transport position.

A foldable, portable basketball assembly 10 is illustrated in FIG. 1 as including a base 20, a support 30 pivotally connected to the base 20 adjacent the front end 21 of the base 20 and wheels 15 connected adjacent a rear end 23 of the base 20. A backboard-rim assembly 40, is connected to the support by 30 an adjustable parallelogram structure 46. A brace assembly 50, including upper brace 52 and lower braces 54, is pivotally connected to the base 20 and support 30 at its ends. A lock 60 maintains the brace assembly 50 in its erect play position as illustrated in FIG. 1 and when unlocked allows the brace assembly to assume its lowered transport positions as illustrated in FIGS. 2 and 3. A shroud 70 is provided on the brace assembly 50 and receives the lock 60.

The foldable, portable basketball assembly, as illustrated in FIG. 1, has the brace assembly 50 in its playing position with the support 30 in its erect position. The support 30 forms a substantially 90° angle with the base 20 and the ground or court surface 12. The lock 60 maintains brace assembly 50 in its play position with the pair of braces 52 and 54 in their coaxial position in FIG. 1 or their extended position of FIG. 3. To transport the assembly, lock 60, 62 is unlocked. To assume its lowered transport position of FIG. 2 as indicated by the arrows in FIG. 1, the support 30 is rotated backwards and the brace assembly 50 is rotated forward until the brace 54 comes into contact with support 30. For the embodiment of FIG. 3, the brace 52 is retracted into brace 54 as the support is rotated backwards until the end of brace 52 engages a stop in brace 54.

The support 30 then extends back over the base 20 at an angle defined by the length of the braces 52 and 54. The angle is greater than 30° and preferably in the range of 50° to 75° and is a function of the weight of the base 30 filled with ballast compared to the weight of the backboard-rim assembly 40. The acute angle is preferable at 60° for a typical backboard-rim assembly of 20 to 30 pounds and ballast filled base in the range of 250 pounds.

Continued angular motion of the support 30 will tilt the base 20 on the wheels 15 so as to support the weight of the base on the wheels as illustrated in FIG. 2. In the non-tilted positions of FIGS. 1 and 3, the wheels 15 are displaced from the ground or surface 12. The acute angle of the support relative to the base 20 as defined by the brace assembly 50 is selected such that the weight of the base 20 is counterbalanced by the backboard-rim assembly 40 when the support 30 is in a substantially horizontal position. This allows ease of transport by minimizing the weight of the system on an individual.

The base 20 has a volume tapered from the rear end 23 diminishing to the front end 21. This shifts the center of gravity of the base 20 closer to the wheels 15 in any of the tilted positions of the base 20. The base 20 preferably is a molded plastic, hollow base having the tapered volume. The cap 24 provides access to the interior of the base 20, allowing it to be filled by ballast material for example, sand, water, etc. An elongated recess 22 in the front end of the base 20 accommodates the pivotal motion of the support 30 relative to the base 20 from its erect position of FIG. 1 to its lowered position of FIGS. 2 and 3.

Flanges 25 extend from each side of the base 20 and includes a recess for the braces 54 and a second recess for the wheels 15. A common pin or bolt pivotally connects the wheel 15 and the brace 54 to the base between the side flange 25 and the main body of the base 20. The wheels 15 are dimensioned so as to be displaced from the surface 12 when the base 20 is in its play or not tilted as illustrated in FIGS. 1 and 3. Once the base 20 is tilted to a transport position, the wheels 15 intersect the ground lifting the base therefrom. Although the braces 54 are connected by a common pin with the wheels 15 to the base 20, separate connections at different positions along the base may be provided. For example, the base 20 may be extended and the braces 54 may be connected closer to the front of the base 20. Also the wheels 15 may be provided on the back wall of the base 20 or may engage the ground 12 even in the play position of FIGS. 1 and 3.

The support 30 may be a single pole or hollow pipe. Preferably, it is a multi-segment element as illustrated in FIG. 3 having sections 32, 34 and 36. This allows ease of packaging of the system. The elements 32, 34 and 36 preferably are configured to have a press fit configuration requiring no additional tools for assembly. As a further alternative, two spaced supports 30 can be provided in individual recess.

The combined backboard-rim assembly 40 includes a backboard 42 and a rim 44 with a height adjustment mechanism 46.

The brace assembly 50 of FIG. 1 includes the brace 52 pivotally connected at its first end to a bracket or clamp 51 by pin. A pin secures the C-bracket 51 to the support 30 at a fixed position. Other clamps or devices may be used to pivotally connect the brace 52 to the support 30 at a fixed position. A pair of braces 54 each are connected to the base 20 by pins. The braces 52 and 54 are pivotally connected to each other by a pin. The lock mechanism 60 includes a hand wheel 62 with a threaded shaft and is mounted to the sheath 70 by a nut or clip and extends there through. The sheath 70 is mounted to the upper ends of brace 54. When the braces 52 and 54 are coaxial in their playing position, the threaded shaft of hand wheel 62 is aligned with and is screwed into a threaded aperture in the lower end of brace 52. This locks the braces 52 and 54 in their coaxial playing position and maintains the support 30 in its erect position. When the lock 60 is in its unlocked position, the thread shaft of hand wheel 62 is disengaged from the thread aperture in braces 52 and the braces 52 and 54 may rotate down to their transport position.

An alternative brace assembly 50 is illustrated in FIG. 3 wherein brace 52 has its ends telescopically received within the end the brace 54. The opposite ends are connected to the support and the base as previously described in FIG. 1. The lock mechanism 60 includes pin 62, which may be the hand wheel and threaded shaft described with respect to FIG. 1, received in a threaded aperture in brace 52. Alternatively, there may be a cotter pin or other locking structure. Two apertures will be provided in the upper brace 52, one defining the erect position of FIG. 1 and a second defining the lowered and transport position of FIG. 3.

Figure 4:
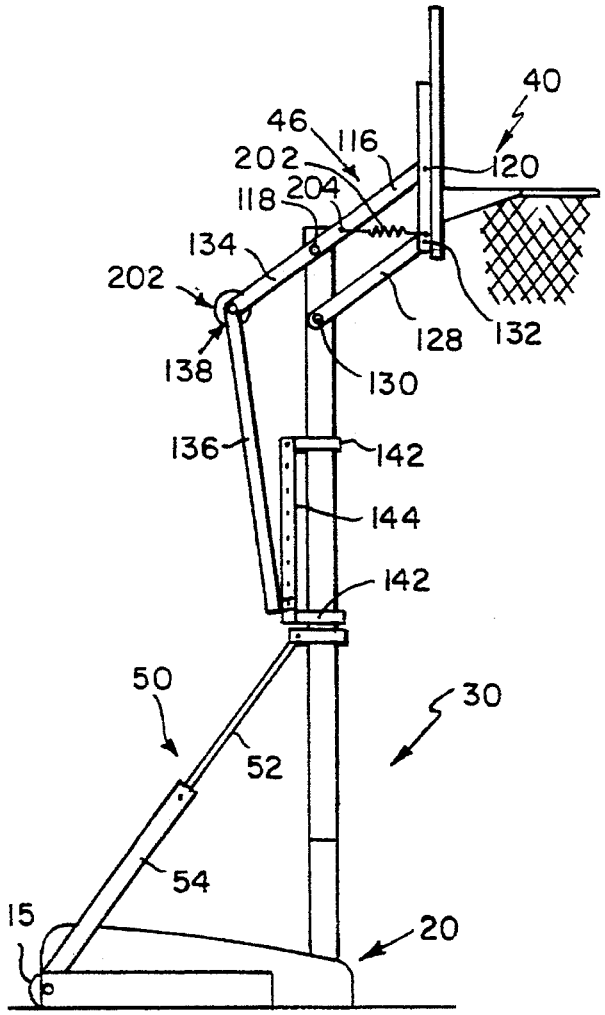
FIG. 4 is a side schematic view of a portable basketball goal incorporating the principles of the present invention in its playing condition.

As in the pivotal FIG. 1 embodiment of the brace 50, the lengths of braces 52 and 54 are selected so as to define the angle of the lowered or transport position of FIG. 4. To positively define the lowered position, the length 52 is selected so as to engage and rest against a stop in brace 54. Preferably, this stop is the pin 15 which connects the wheels and the brace 54 to the base. This also acts as a stop for the collapsing of the support 30 and the backboard. The brace 54 is also selected so as to not intersect or engage the pivotal connection of the brace 52 to the support 30. This removes any pinch point in the brace mechanism. In a single support 30, a single brace 52 and a single brace 54 is used. Where a pair of supports 30 are used, each would include a single brace 52 and a brace 54.

During transport, the structures of FIGS. 1–3, from the above discussed prior application which are incorporated herein by reference, counterbalance the weight of the backboard-rim combination 40 with the weight of the base 20 on the wheels 15. Another improvement of these systems, would be to provide a second wheel or set of wheels adjacent to the top of the support 30. The preferred embodiment as illustrated in FIGS. 4–9 include the second wheel at an extension of a parallelogram. This maintains the top of the support 30 off the ground and makes it more manageable in steering. Alternatively, the wheel may be attached anywhere adjacent to the top of the support 30, even including the structure of FIGS. 1–3.

Figure 10:
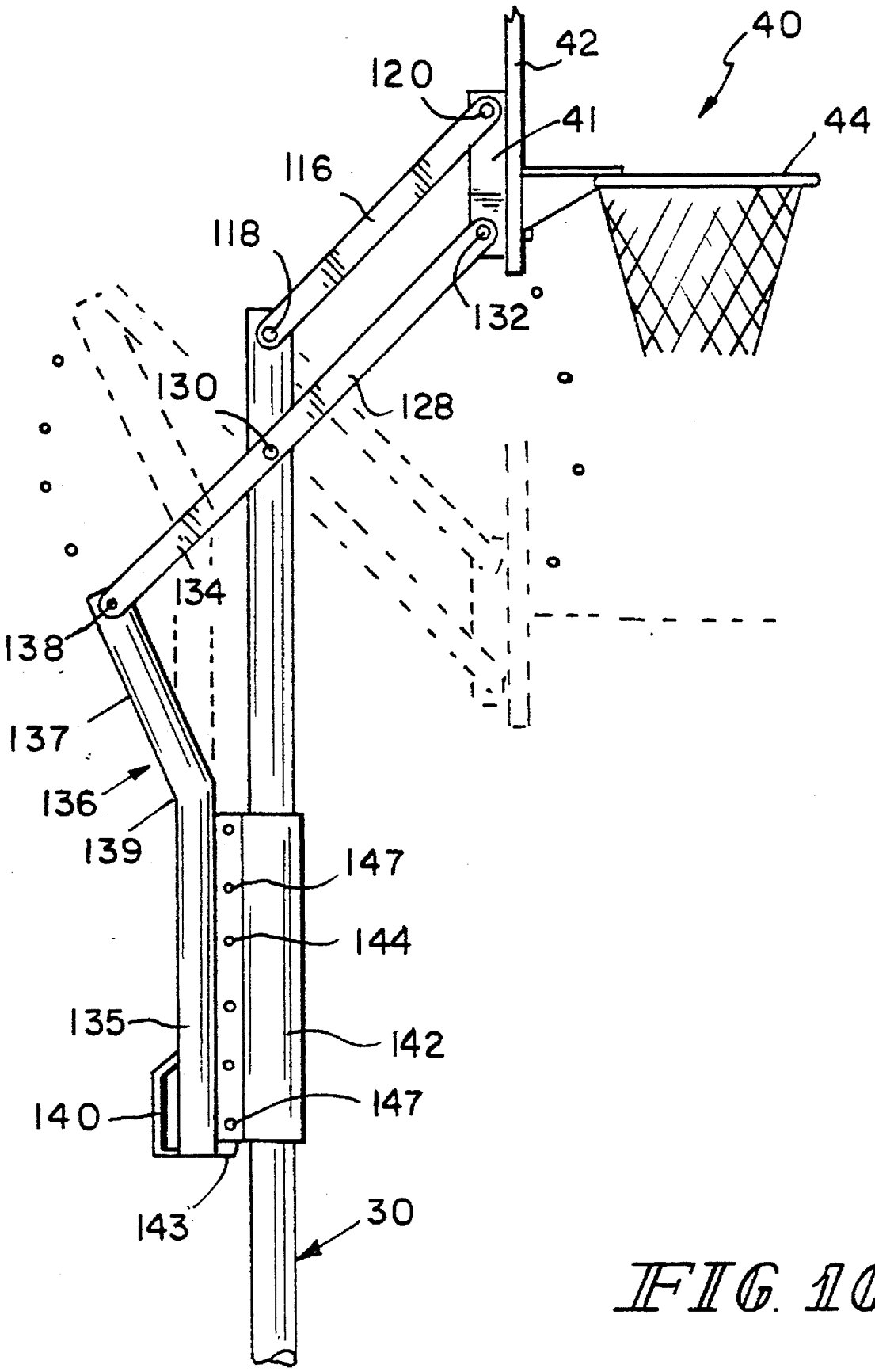
FIG. 10 is a side schematic view of an adjustable basketball goal assembly incorporating a further embodiment of the present invention.

The adjustable parallelogram structure 46 for the backboard-rim assembly 40 in FIGS. 4–7 include an extension 134 on one of the legs 116, 128 of the parallelogram structure 46. The upper arms 116 of the parallelogram structure are pivotally connected to support 30 at 118 and to the backboard at 120. The lower leg 128 is pivotally connected to the support 30 at 130 and to the backboard at 132. It should be noted that although the extension 134 in FIGS. 4–7 is illustrated as extending from one or more of the upper legs 116 of the parallelogram, the extension 134 may also extend from one or more of the lower legs 128 as illustrated in FIG. 10. An adjustment link 136 is pivotally connected at 138 to the end of the extension 134 at one end and is adjustably connected to the support 30 at its other end.

A handle 140 is provided with a bracket 143 attached to the bottom of link 136 or directly thereto as by welding or bolting. Attached to the support member 30 is an anchor illustrated as a C-clamp bracket 142. This bracket 142 can be welded, bolted or otherwise fixed to the support member 30 and is provided with extending lips 144 that have a plurality of height adjustment holes 146 thereon. The C-clamp bracket 142 is illustrated in FIGS. 4–9 as individual C-clamps 142 with a lip 144 therebetween and in FIG. 10 as a unitary structure of the C-clamp 142 and the lip 144. A bracket 143 at the end of the link 136 is attached to at least one of these holes 146 in lip 144 by a pin 147 to determine the height of the basketball backboard 42 by changing the angle of link 136 and legs 128 and 116 with respect to the support member 30.

The handle 140 allows the adjustment link to be held and moved upward and downward with one hand while a second hand positions the pin 147 through a pair of holes in bracket 143 and a selected pair of corresponding holes 146 in the lips 144 of bracket 142 to provide the correct height relationship between the ground and the basketball backboard 42. This connection via pin 147 can be provided with a padlock assembly.

The just described structure is that illustrated in U.S. patent application Ser. No. 07/921,645 which is incorporated herein by reference. This parallelogram and adjustment structure is mounted to the support 30 and base 20 of FIGS. 1–3 and may include either of the brace structures 50. As a first modification to the above mentioned patent application structure, one or more wheels 200 are provided connected to the extension 134 at the pivotal connection 138 of the extension 134 and the adjustment link 136. Since this pivotal connection is the location of the furthest extended element of the top of the support 130, it is the preferred location. As illustrated specifically in FIG. 7, a pair of wheels 200 act as spacers and separate the adjustment link 136 from a pair of extension 134 of parallelogram leg 116. This allows the adjustment link 136 to be smaller than the diameter of the support 30.

The brace 50 and the support 30 with respect to the base 20 are shown in their erect playing position in FIGS. 4, 8, and 9. It should also be noted that the backboard 40 is at its highest height with the adjustment link 136 connected at the lowest aperture in the lip 144. To change the assembly to its transport position, it is preferable, to perform two initial functions, in either order. One of the functions is to pivot the support 30 relative to the base 20 from its erect playing position to its lowered transport position by manipulating the brace 50. The second operation is adjusting the backboard-rim 40 to its lowest height by connecting the adjustment link 136 at the top of the lip 144. The structure after these two operations is illustrated in FIG. 5.

Figure 5:
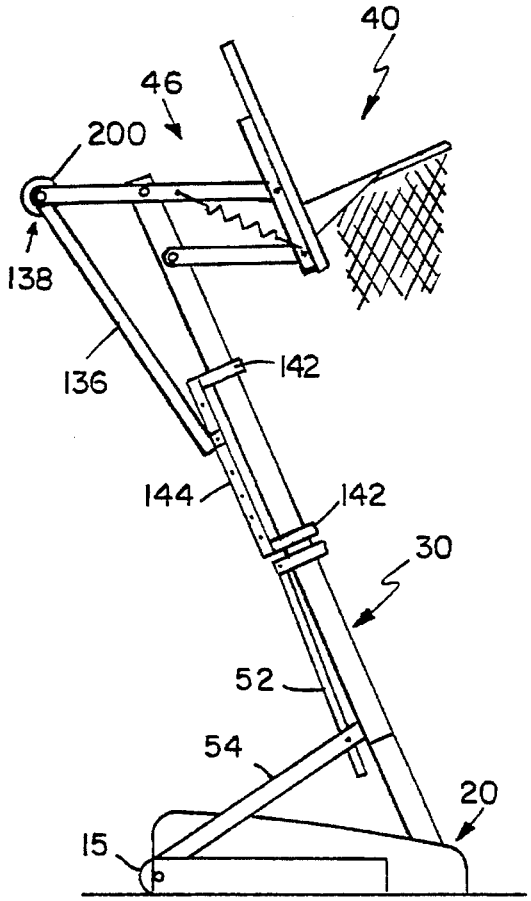
FIG. 5 is a side schematic view of the basketball goal assembly of FIG. 4 in its lowered non-transport position.

Comparison between FIGS. 4 and 5 would reveal that the perpendicular distance between the support 30 and the wheel 200 has been increased between the highest height adjustment and the lowest height adjustment of the backboard. Although the furthest perpendicular distance of the wheel 200 from the support 30 would be when the extension 134 is perpendicular to the support 30, but this position is not easily defined on the lip 144. As an alternative, a special marking may be provided on the lip to indicate this position.

Figure 6:
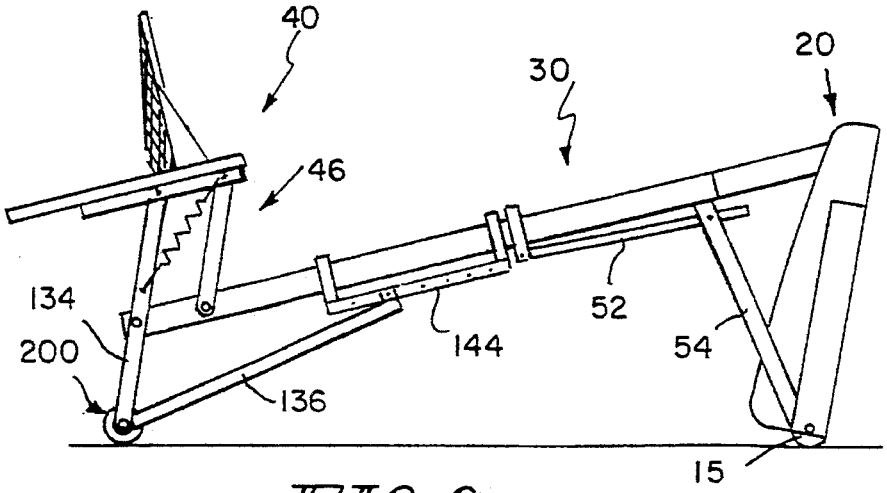
FIG. 6 is a side schematic view of the foldable, portable basketball goal assembly of FIG. 4 in its lowered and transport position.

Once the assembly is in the position illustrated in FIG. 5, the base 20 is tilted on to wheels 15 on the base. Further angular motion of the structure and the base 20 causes the wheels 200 to engage the ground and support the backboard structure 40. This stable transport position is illustrated in FIG. 6.

Although the addition of a wheel 200 on an extension 134 of the parallelogram structure is shown used with a support pivotally connected to the base 20, it may also be used with the support 30 rigidly connected to the base 20. This would cause the base 20 to be substantially more vertical than that illustrated in FIG. 6 and thereby shifting more of the weight onto the rear wheel 200 and the operator during the final stages of the angular rotation of the base. It should also be noted that the adjustment of the backboard 40 to its lowest height is also not necessary and would result in the top of the support 30 being substantially closer to the ground. This also would result in the base 20 being substantially more vertical than that illustrated in FIG. 6 and also may make it less convenient for the operator to push or steer the system in its transport position.

As a further modification to the above mentioned patent application Ser. No. 07/921,645, additional counterweight mechanisms are provided for the height adjustment mechanism. As illustrated in FIG. 4–6, a resilient element 202, for example, a tension spring, is connected between the legs of the parallelogram. As illustrated, one end of the spring 202 is connected at pivot point 132 for the lower leg 128 and the second end is connected to the upper leg 116 at 204. As an alternative, the other end of the spring 204 may also be connected to the support 30 or a first end 132 that may be connected to a different portion of the backboard 40.

The counterbalance may also be provided as illustrated in FIG. 8 by a torsional spring 208 provided either one or both of the pivotal connections 118 and 130 of the parallelogram legs 116 and 128 to the support 30. As an alternative, the torsional springs may also be provided at the pivotal connections 120, 132 of the upper leg 116 and the lower leg 128 to the backboard 40.

A third embodiment which uses springs as counterbalances is illustrated in FIG. 9. The adjustment link 136 includes two telescopic members 135 and 137. The top telescopic number 137 is pivotally connected at 138 to the extension 134 of the parallelogram. The lower section 135 is pivotally connected to the C-clamp 147 on the support 30. A spring 210, interior the upper section 137, is connected at the pivot point 138 at one end and is connected to the lower section 135 or at the connection 135 to clamp 142 at its other end. Pin 147 extends through the two telescopic sections 135 and 137 to lock it in the adjustable position. This allows the spring 210 to provide the counterbalance during the adjustment mechanism and to basically disable the spring after adjustment and while playing basketball.

As is evident from FIG. 4, 8 and 9, the adjustment link 136 forms a V with the support 30. The height of the V is lowest when the backboard 40 is at its highest height. For the embodiments of FIGS. 4, 8 and 9, this height is generally in the 4 to 5 foot range. To minimize any danger from this V, modification illustrated in FIG. 10 is proposed. The adjustment link 136 is formed of two sections, 135 and 137. In this instance, the section 135 and 137 may be fixed or pivotally joined at a juncture at 139. The upper section 137 is pivotally connected to the extension 134 of the parallelogram structure 136 at 138. The upper section 137 forms an obtuse angle with the vertical or lower section 135. The lower section 135 is connected to the C-clamp bracket 142 by pin 147. A mechanism may be provided to keep the section 135 substantially vertical and adjacent to the support 30.

As is evident in FIG. 10, this raises the V formed between section 137 and the support 30 to the juncture at 139. Again, the bottom of the V is its lowest when the backboard 40 is at its highest height. Depending upon the length selected, the vertical section 135, the lowest point of the junction 137 would be in the 6 foot or above range.

One of the mechanisms used to keep the vertical section 135 vertical, would be to attach the lower section 135 at two points, using two pins 137 to the lip 144. Another method would be one of the handles described in my copending U.S. application 08/181,436 filed Jan. 14, 1994. This is especially important if sections 135 and 137 are pivotally connected. Even if vertical section 135 begins to form small angles with respect to the support 30, these would be at the lower positions of the backboard and thus, the V would be above the minimum 6 foot range. Alternatively, the lip 144 of the anchor may be enlarged at the top to cover any separation of the section 135 from vertical.

The adjustment link 136 using two section 135 and 137, illustrated in FIG. 10, may be used with the portable structure of the previous figures, or in a fixed ground structure.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A foldable portable basketball goal assembly comprising:

a base having first and second ends;

a support connected at a first end adjacent said first end of said base;

a backboard-rim combination connected to a second end of said support by an adjustable parallelogram structure; and at least one first wheel adjacent said second end of said base and at least one second wheel adjacent said second end of said support for transporting said assembly when said base is tilted.

2. The assembly according to claim 1, wherein said support is pivotally connected to said base; and including a brace means pivotally connected to said base and said support for determining in a playing position a fixed erect position of said support forming substantially a ninety degree angle with said base and determining in a transport position a fixed lowered position of said support forming an acute angle greater than zero with said base.

3. The assembly according to claim 2, including lock means operatively connected to said brace means for locking said brace means in said playing position in a locking condition of said lock means and permitting said brace means to assume said transport position in an unlocked condition of said lock means.

4. The assembly according to claim 2, wherein said brace means includes a first and second brace means pivotally connected to each other at their first ends and pivotally connected at their second ends respectively to said base and said support.

5. The assembly according to claim 2, wherein said brace means includes a first and second brace means telescopically connected to each other at their first ends and pivotally connected at their second ends respectively to said base and said support.

6. The assembly according to claim 1, wherein one leg of said parallelogram structure includes an extension extending past said support towards said second end of said base; and the second wheel is adjacent an end of said extension of said one leg.

7. The assembly according to claim 6, wherein said parallelogram structure includes an adjustment means for adjustably connecting said extension of said one leg to said support for determining the height of the backboard-rim combination.

8. The assembly according to claim 7, wherein said adjustment means and said second wheel are connected to said extension on a common axis.

9. The assembly according to claim 8, wherein said second wheel is an axial spacer between said adjustment means and said extension.

10. The assembly according to claim 7, wherein said adjustment means includes a first vertical section adjustable connected to said support and a second section extending from said first section at an obtuse angle and connected to said extension.

11. The assembly according to claim 10, including means for maintaining said vertical section of said adjustment means substantially vertical and adjacent said support.

12. The assembly according to claim 10, wherein the juncture of the first and second sections is six feet or above when the adjustment means determines the highest height of the backboard-rim combination.

13. The assembly according to claim 1, wherein said base is hollow and is filled with ballast.

14. The assembly according to claim 1, wherein said base is has a greater mass than said backboard-rim combination.

15. A method of transporting a basketball goal assembly having a support connected adjacent a first end of a base, a backboard-rim combination adjustably connected on said support by a parallelogram structure, at least one first wheel adjacent a second end of said base and at least one second wheel on an extension of a leg of the parallelogram structure; the method comprising:

tilting said base from a playing position toward a transport position and onto said first wheel; and continuing the angular motion of said base to tilt said parallelogram structure and backboard-rim combination onto said second wheel for transport.

16. A method according to claim 15, wherein a support is pivotally connected to said base and has an erect playing position and a lowered transport position relative to said base; and said method further includes initially pivoting said support from said erect playing position to said lowered transport position relative to said base.

17. A method according to claim 15, including initially adjusting said backboard-rim combination to its lowest position.

18. An adjustable basketball goal assembly comprising:

a support;

a backboard-rim combination connected to said support by an adjustable parallelogram structure;

one leg of said parallelogram structure includes an extension extending past said support;

an adjustment means for adjustably connecting said extension of said one leg to said support for determining the height of the backboard-rim combination;

said adjustment means including a first vertical section adjustable connected to said support with an adjustment element at a first end of said first vertical section and a second section extending from a second end of said first section, which is substantially higher than said first end, at an obtuse angle and connected to said extension; and the juncture of the first and second sections being six feet or above when the adjustment means determines the largest height of the backboard-rim combination.

19. The assembly according to claim 18, including means for maintaining said vertical section of said adjustment means vertical and adjacent said support.

20. The assembly according to claim 18, wherein said adjustment means includes a bracket secured to said support and said first vertical section is spaced from said support and adjustably connected to said bracket.

* * * * *